US005174580A

United States Patent [19]

Pratt

[11] Patent Number: 5,174,580

[45] Date of Patent: Dec. 29, 1992

[54] BALL TOSS AND CATCH TOY

[75] Inventor: Kenneth W. Pratt, Ware, Mass.

[73] Assignee: Seneca Sports, Inc., Milford, Mass.

[21] Appl. No.: 870,687

[22] Filed: Apr. 17, 1992

[51] Int. Cl.[5] ..... A63B 59/02

[52] U.S. Cl. ..... 273/326

[58] Field of Search ..... 273/326

[56] References Cited

U.S. PATENT DOCUMENTS

| | | | |
|---|---|---|---|
| 3,170,688 | 2/1965 | Porter | 273/326 |
| 3,822,062 | 7/1974 | Tucker et al. | 273/326 |
| 3,871,653 | 3/1975 | Sambos | 273/326 |
| 3,910,578 | 10/1975 | Brine, Jr. | 273/326 |
| 3,992,008 | 11/1976 | Watkin | 273/326 |
| 4,034,984 | 7/1977 | Crawford et al. | 273/326 |
| 4,045,026 | 8/1977 | Gillespie et al. | 273/326 |
| 4,138,111 | 2/1979 | Rule | 273/326 |
| 4,153,251 | 5/1979 | Pond | 273/326 |
| 4,270,756 | 6/1981 | Ahlenfield et al. | 273/326 |
| 4,940,243 | 7/1990 | Tucker et al. | 273/326 |
| 5,018,746 | 5/1991 | Cardoza, Jr. et al. | 273/411 |
| 5,048,843 | 9/1991 | Dorfi et al. | 273/326 |
| 5,054,790 | 10/1991 | Brine, III et al. | 273/326 |

FOREIGN PATENT DOCUMENTS 1589596 5/1981 United Kingdom .

*Primary Examiner*—William H. Grieb
*Attorney, Agent, or Firm*—Fish & Richardson

[57] ABSTRACT

A sport toy for tossing and catching a ball has a frame defining an open, ball-receiving region, a webbing attached to the frame and spanning the ball-receiving region and a handle connected to the frame. The frame has a front member and a rear member. The front member has a throat wall, a pair of opposed side walls diverging from the throat wall and an end wall spaced from the throat wall and extending between the pair of side walls. The webbing, formed of a resiliently deformable material, has a peripheral rim that is secured between the frame members.

26 Claims, 7 Drawing Sheets

BALL TOSS AND CATCH TOY

BACKGROUND OF THE INVENTION

The invention relates to sport toys of the type for catching and tossing a ball.

Examples of sport toys of the general type described include a unitary device having a flexible body of resilient material defining a semi-spherical pocket, as described in Porter U.S. Pat. No. 3,170,688; a racquet of tubular material shaped into an annular head with a loose netting, as described in Watkin U.S. Pat. No. 3,992,008; a racquet consisting of a flexible shaft with planar structures at each end defining bowl-shaped networks for catching a sphere, as described in Cardoza, Jr. et al. U.S. Pat. No. 5,018,746; and miniature lacrosse sticks with plastic heads and woven or knitted fiber nets, as sold commercially by Stx Inc., W. H. Brine Co. and others.

SUMMARY OF THE INVENTION

According to one aspect of the invention, a sport toy for tossing and catching a ball comprises a frame defining an open, ball-receiving region, a webbing attached to the frame and spanning the ball-receiving region, and a handle connected to the frame. The frame comprises a front frame member having a throat wall portion, a pair of opposed side wall portions diverging from the throat wall portion and an end wall portion spaced from the throat wall portion and extending between the pair of opposed side wall portions, and a rear frame member. The webbing, formed of a resiliently deformable material, has a peripheral rim sized and adapted to be secured between the front frame member and the rear frame member.

Preferred embodiments of this aspect of the invention may include one or more of the following features. The end wall of the front frame member has a front surface that slopes from a front edge of the front frame member toward the throat wall portion, and the webbing defines a pocket in a region of the throat wall portion for receiving and retaining a ball. The webbing comprises an integral unit of molded plastic, the webbing defining a ball-receiving surface extending at least between the throat wall portion and the end wall portion, the ball-receiving surface being relatively more spaced from a front edge of the frame in a region of the throat wall portion than in a region of the end wall portion, the ball-receiving surface in the region of the end wall portion lying generally tangent with an adjacent portion of the front surface, whereby a ball entering the ball-receiving region during catching is deflected by the ball-receiving surface of the webbing toward the pocket, and a ball leaving the ball-receiving region during throwing passes smoothly from the ball-receiving surface to the front surface. Preferably, a segment of the webbing in a region of the pocket extends generally perpendicular to a plane of the front edge for further defining the pocket. The webbing is adapted to deflect resiliently with contact of a ball upon the ball-receiving surface to facilitate catching of a ball, and the webbing is adapted to resist deflection as a ball passes along the ball-receiving surface during throwing. The front frame member further comprises a front wall extending generally along a front edge of the front frame member in a region of the throat wall portion, the front wall together with the throat wall portion and the webbing defining a pocket sized for receiving and retaining a ball. The webbing comprises an integral unit of molded plastic, the webbing defining a ball-receiving surface extending at least between the throat wall portion and the end wall portion. The front frame member further comprises a frame sleeve disposed upon an outer surface of the front frame member in a region of the throat wall portion, the frame sleeve sized for receiving an end of the handle for fixed connection of the frame and the handle. The sports toy further comprises means for securing the front frame member to the rear frame member, with the peripheral rim of the webbing disposed therebetween, e.g. the means for securing the front frame member to the rear frame member may comprise an elongated tab defined by the rear frame member and sized and constructed for engagement within the frame sleeve, a plurality of pairs of corresponding, overlying tabs defined by the front frame member and the rear frame member, and fasteners, e.g. rivets, sized and adapted for fixed joining together of the pairs of corresponding, overlying tabs, and/or a plurality of pin elements formed integrally with, e.g., the rear frame member, a plurality of orifices defined by an opposed surface of, e.g., the front frame member and aligned with and corresponding to the plurality of pin elements, and a plurality of apertures defined by the peripheral rim of the webbing and similarly aligned with and corresponding to the plurality of pin elements and the plurality of orifices, the pin elements extending through the apertures and into engagement in the orifices for securement together of the front frame member and the rear frame member, with the peripheral rim of the webbing therebetween. The handle is of a length, e.g. seven inches, suitable for use of the toy with one hand, or it may be of a length, e.g. sixteen inches, suitable for use with two hands, a first hand-grasping region being defined by the handle adjacent the frame sleeve and a second hand-grasping region being defined by the handle at a distance spaced from the first hand-grasping region, thereby to permit throwing of a ball with a two-handed motion. The handle, at least in the one hand embodiment, comprises a sleeve of cushioning material.

According to another aspect of the invention, a sport toy for tossing and catching a ball comprises a frame defining an open, ball-receiving region, a webbing attached to the frame and spanning the ball-receiving region, and a handle connected to the frame. The frame comprises a front frame member having a throat wall portion, a pair of opposed side wall portions diverging from the throat wall portion and an end wall portion spaced from the throat wall portion and extending between the pair of opposed side wall portions, the end wall portion having a front surface that slopes from a front edge of the front frame member toward the throat wall portion, and a rear frame member. The webbing comprises an integral unit of molded, resiliently deformable plastic, the webbing having a peripheral rim sized and adapted to be secured between the front frame member and the rear frame member, the webbing defining a pocket in a region of the throat wall portion for receiving and retaining a ball, and the webbing further defining a ball-receiving surface extending at least between the throat wall portion and the end wall portion, the ball-receiving surface being relatively more spaced from a front edge of the frame in a region of the throat wall portion than in a region of the end wall portion, the ball-receiving surface in the region of the end wall portion lying generally tangent with an adjacent portion of the front surface, a segment of the webbing in a region of the pocket extending generally perpendicular to a plane of the front edge for defining the pocket, and the webbing is adapted to deflect resiliently with contact of a ball upon the ball-receiving surface to facilitate catching of a ball, and the webbing is adapted to resist deflection as a ball passes along the ball-receiving surface during throwing, whereby a ball entering the ball-receiving region during catching is deflected by the ball-receiving surface of the webbing toward the pocket, and a ball leaving the ball-receiving region during throwing passes smoothly from the ball-receiving surface to the front surface.

In preferred embodiments of this aspect of the invention, the front frame member further comprises a frame sleeve disposed upon an outer surface of the front frame member in a region of the throat wall portion, the frame sleeve sized for receiving an end of the handle for fixed connection of the frame and the handle, and the sports toy further comprises means for securing the front frame member to the rear frame member, the means for securing comprising: an elongated tab defined by the rear frame member, the elongated tab being sized and constructed for engagement within the frame sleeve, a plurality of pairs of corresponding, overlying tabs defined by the front frame member and the rear frame member with fasteners sized and adapted for fixed joining together of the pairs of corresponding, overlying tabs, and a plurality of pin elements formed integrally with the rear frame member, a plurality of orifices defined by an opposed surface of the front frame member and aligned with and corresponding to the plurality of pin elements, and a plurality of apertures defined by the peripheral rim of the webbing and similarly aligned with and corresponding to the plurality of pin elements and the plurality of orifices, the pin elements extending through the apertures and into engagement in the orifices for securement together of the front frame member and the rear frame member, with the peripheral rim of the webbing therebetween. The handle may be of a length suitable for use of the toy with one hand or for use of the toy with two hands, and, at least in the one hand embodiment, it may have a handle sleeve of cushioning material.

According to another aspect of the invention, a sport toy for tossing and catching a ball comprises a frame defining an open, ball-receiving region, a webbing attached to the frame and spanning the ball-receiving region, a handle connected to the frame, and means for securing the front frame member to the rear frame member, with the peripheral rim of the webbing disposed therebetween. The frame comprises a front frame member having a throat wall portion, a pair of opposed side wall portions diverging from the throat wall portion and an end wall portion spaced from the throat wall portion and extending between the pair of opposed side wall portions, and a frame sleeve disposed upon an outer surface of the front frame member in a region of the throat wall portion, the frame sleeve sized for receiving an end of the handle for fixed connection of the frame and the handle, and a rear frame member. The webbing is formed of a resiliently deformable material and it has a peripheral rim sized and adapted to be secured between the front frame member and the rear frame member. The means for securing comprises an elongated tab defined by the rear frame member, the elongated tab being sized and constructed for engagement within the frame sleeve, a plurality of pairs of corresponding, overlying tabs defined by the front frame member and the rear frame member with fasteners sized and adapted for fixed joining together of the pairs of corresponding, overlying tabs, and a plurality of pin elements formed integrally with the rear frame member, a plurality of orifices defined by an opposed surface of the front frame member and aligned with and corresponding to the plurality of pin elements, and a plurality of apertures defined by the peripheral rim of the webbing and similarly aligned with and corresponding to the plurality of pin elements and the plurality of orifices, the pin elements extending through the apertures and into engagement in the orifices for securement together of the front frame member and the rear frame member, with the peripheral rim of the webbing therebetween.

Objectives of the invention include providing a sport toy for catching and tossing a ball, the toy having a frame defining an opening spanned by a deformable webbing mounted on a handle of length selected for one-hand or two-hand throwing. The structure of permits the webbing to be securely attached to the frame, and the frame mounted upon the handle, in a manner permitting efficient use of labor. The material of the webbing and the relationship of the webbing surface with the surface of the frame end wall provide for smooth release of the ball from the toy for accurate throwing.

These and other features and advantages of the invention will be seen from the following description of a presently preferred embodiment, and from the claims.

DESCRIPTION OF A PRESENTLY PREFERRED EMBODIMENT

Figure 1:
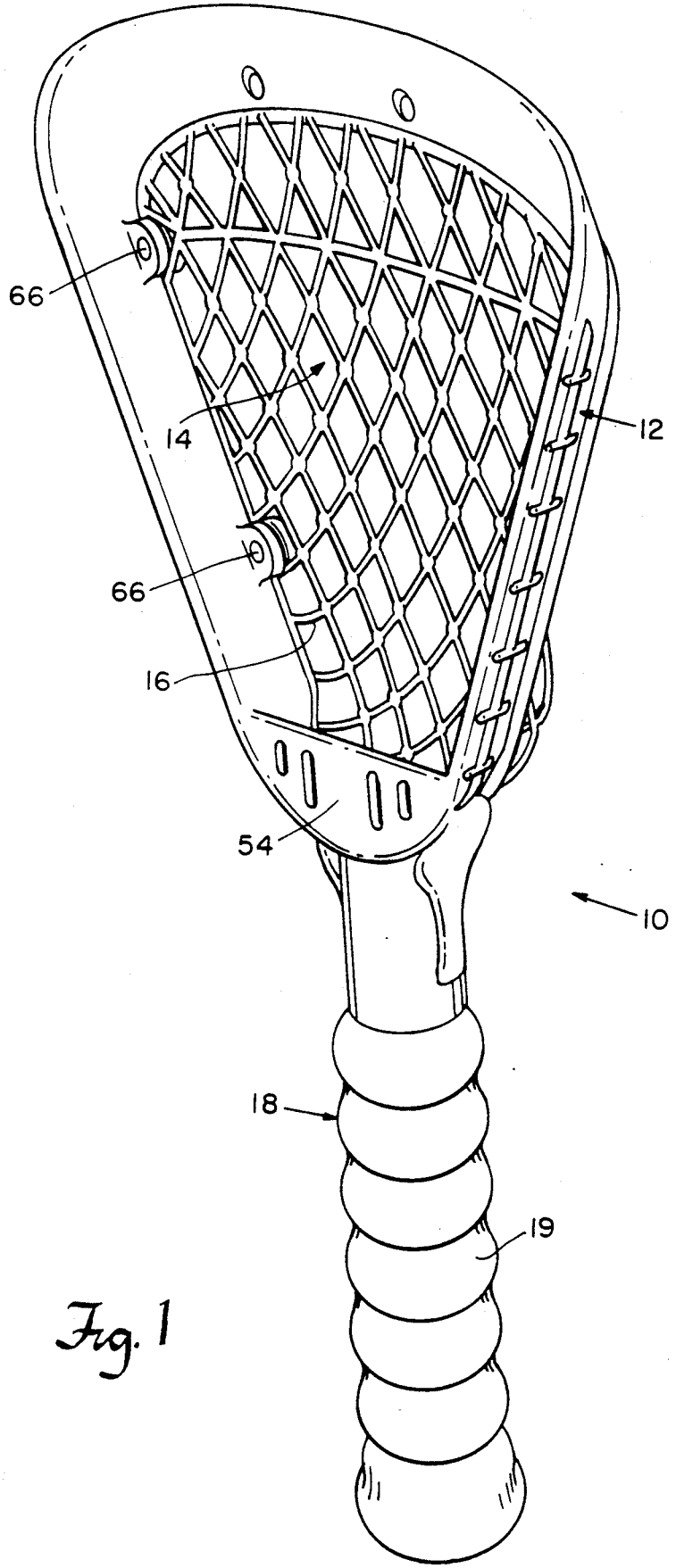
FIG. 1 is a perspective view of one embodiment of a sports toy of the invention.
Figure 2:
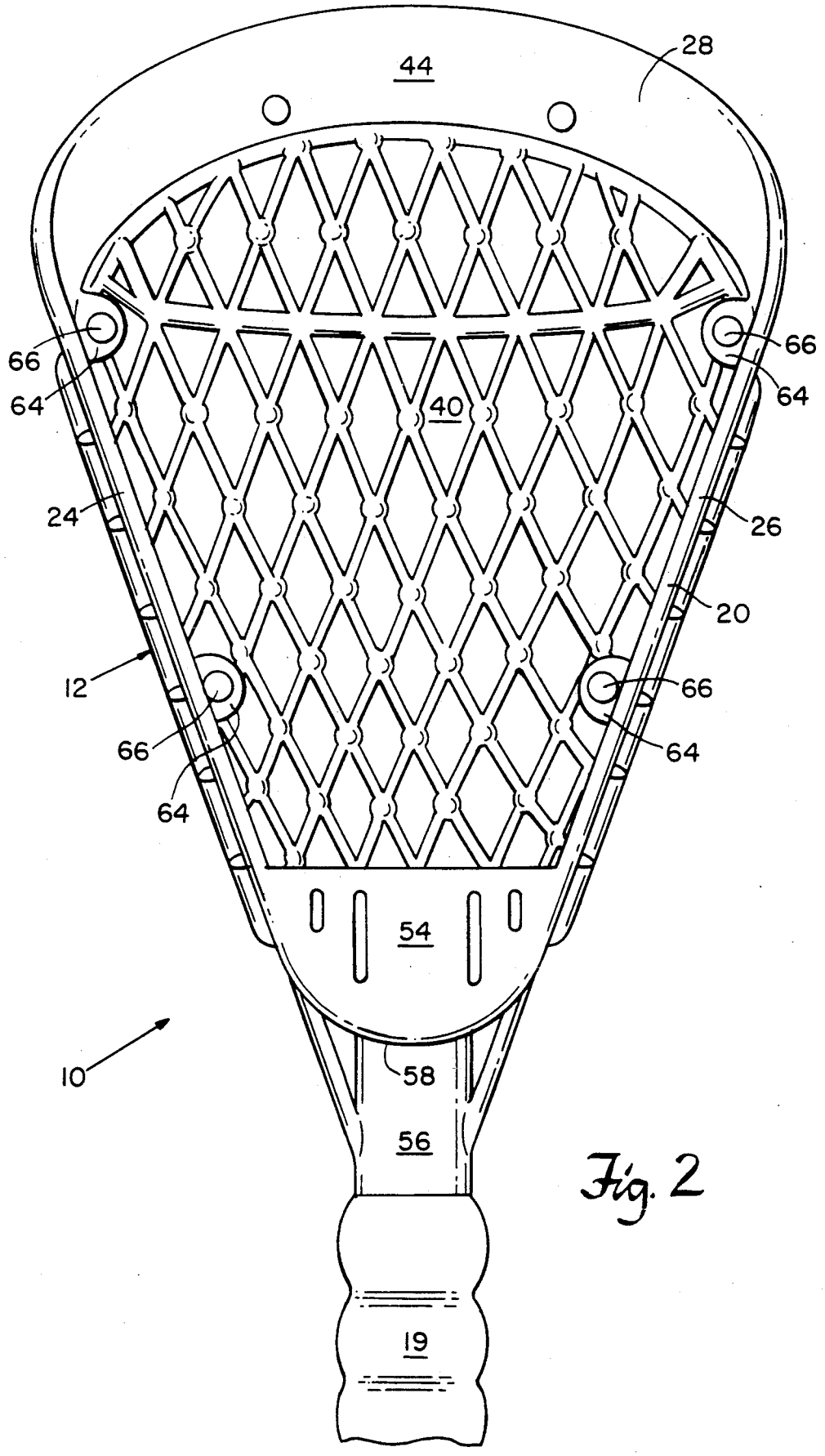
FIG. 2 is a front plan view of the sports toy shown in FIG. 1.
Figure 3:
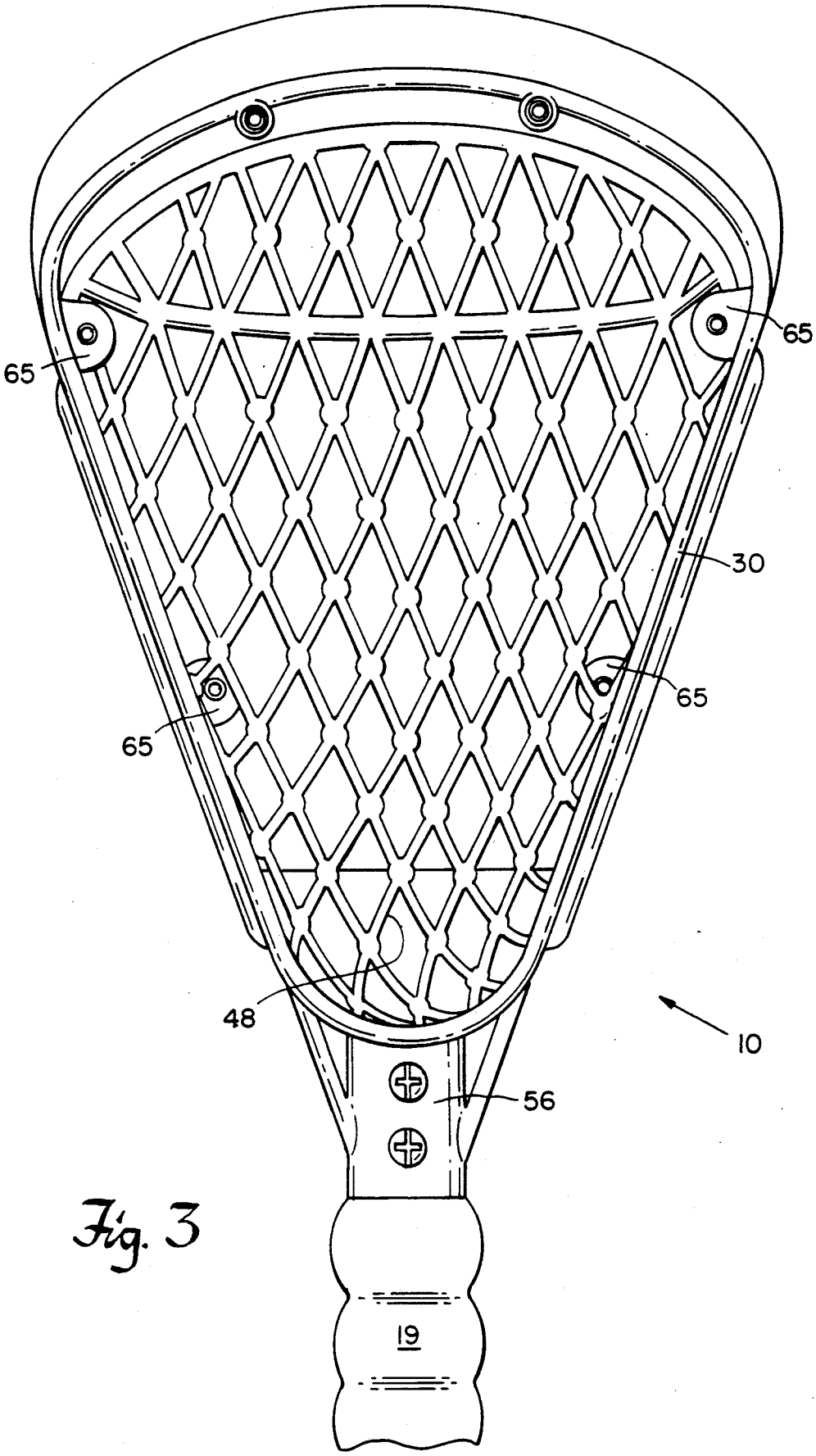
FIG. 3 is a rear plan view of the sports toy shown in FIG. 1.
Figure 4:
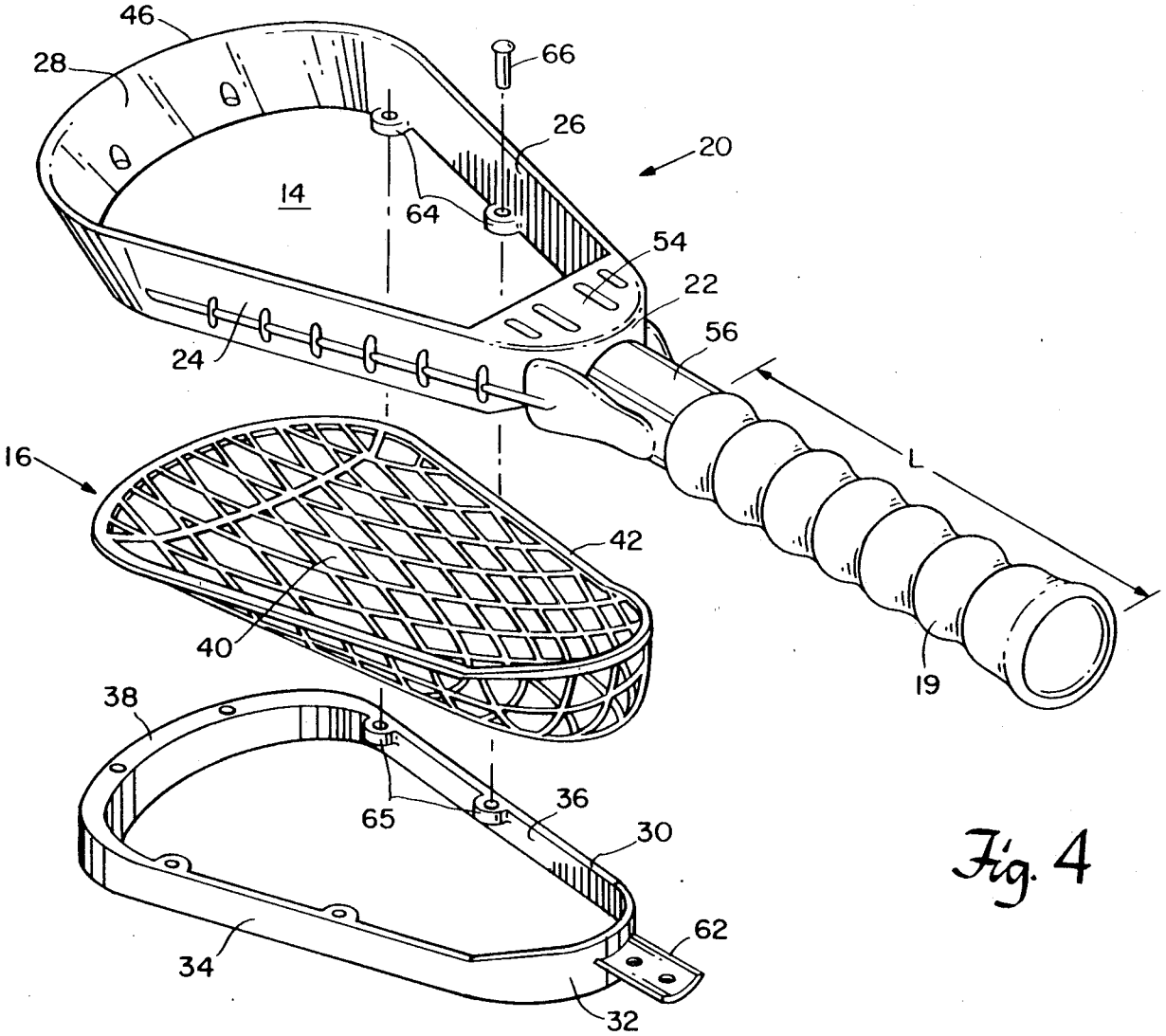
FIG. 4 is an exploded view of the sports toy shown in FIG. 1.

Referring now to FIG. 1, a sport toy 10 of the invention for tossing and catching a ball has a frame 12 defining an open, ball-receiving region 14, a webbing 16 attached to the frame 12 and spanning the ball-receiving region 14, and a handle 18 connected to the frame.

Referring now also to FIGS. 2 through 6, the frame 12 includes a front frame member 20 and a rear frame member 30, both formed of a suitable, strong, rugged plastic material capable of retaining its shape. The front frame member has a throat wall 22 (best seen in FIGS. 5 and 6), a pair of opposed side walls 24, 26 that diverge from the throat wall 22, and an end wall 28 that is spaced from the throat wall 22 and extends between the pair of opposed side walls. In the preferred embodiment described, the rear frame member 30 also has a throat wall portion 32, a pair of opposed side wall portions 34, 36 that diverge from the throat wall portion 32, and an end wall portion 38 that is spaced from the throat wall portion 32 and extends between the pair of opposed side wall portions.

The webbing 16 is formed of a suitable, semi-flexible, resiliently deformable material, e.g. HYTREL® plastic having a Rockwell C durometer of about 35. The webbing includes an open grid section 40 that spans to open, ball-receiving region 14 of the frame 12, and a peripheral rim 42 that is sized and adapted to be secured between the front frame member 20 and the rear frame member 30, as described more fully below.

Figure 5:
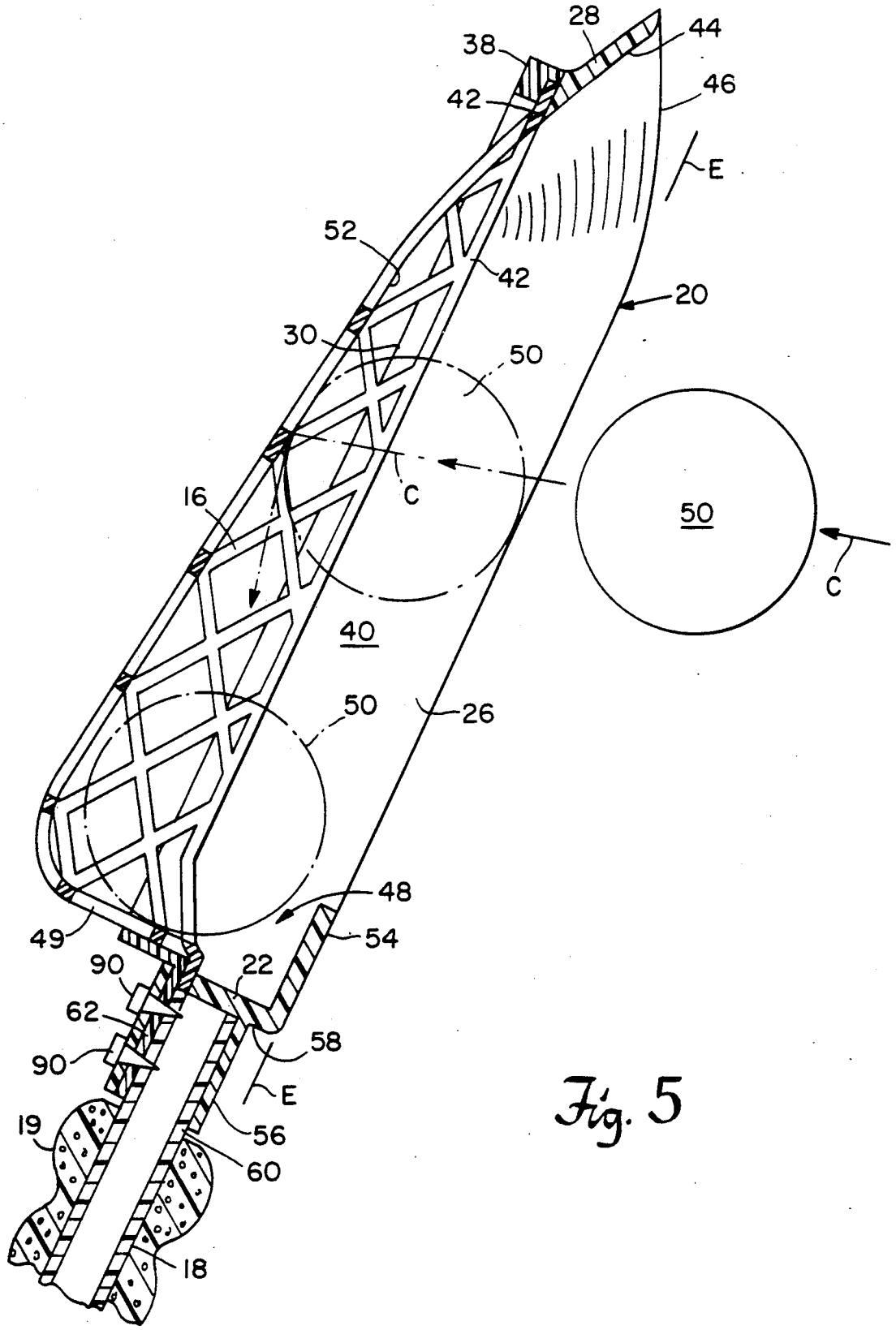
FIGS. 5 and 6 are side sectional views of the sports toy shown in FIG. 1.
Figure 6:
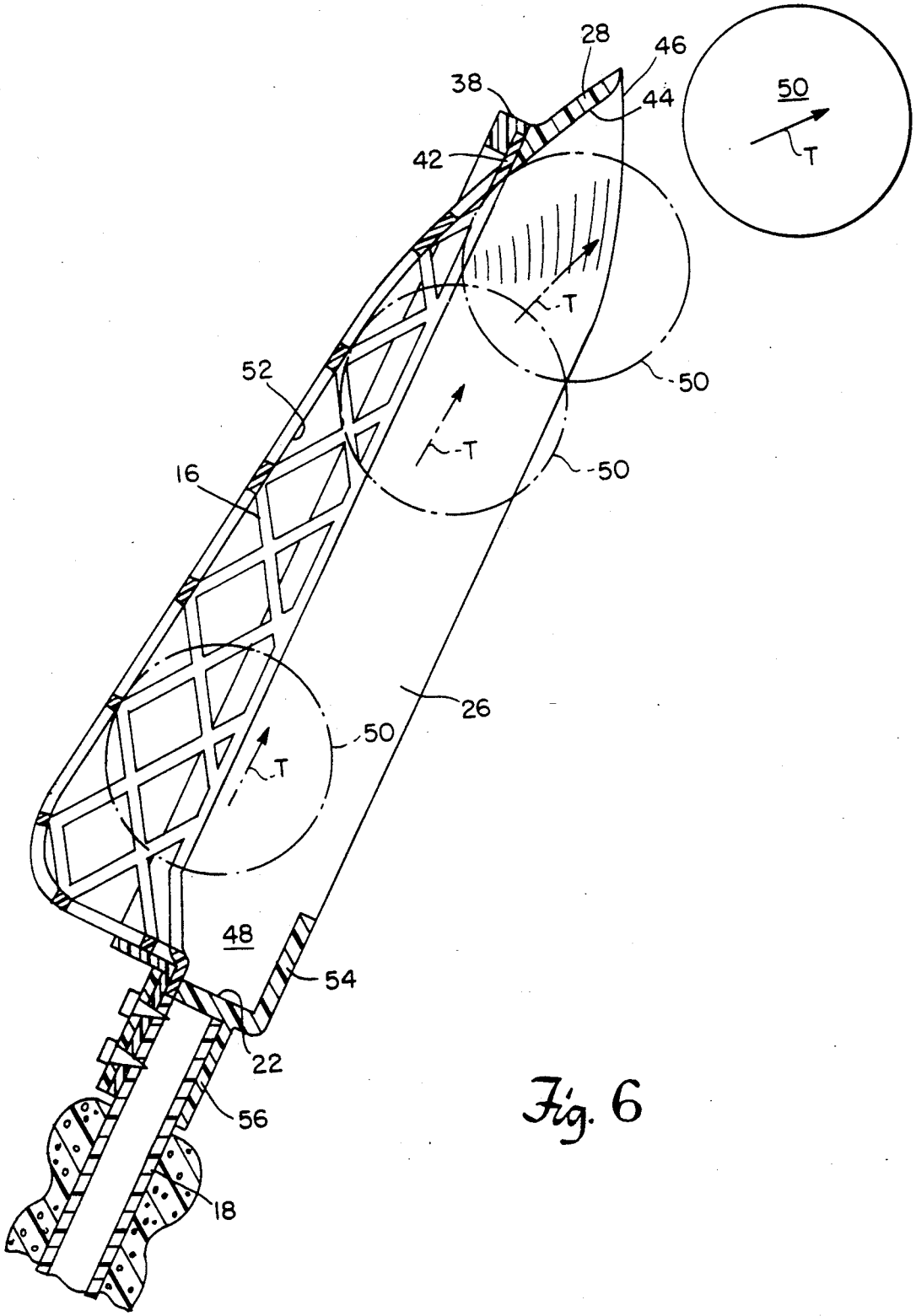

Referring in particular to FIGS. 5 and 6, the end wall portion 28 of the front frame member 20 has a front surface 44 that slopes from a front edge 46 of the front frame member toward the throat wall portion 22, and the webbing 16 defines a pocket 48 in a region of the throat wall portion for receiving and retaining a ball 50. The front frame member 20 further includes a front wall 54 extending generally along the front edge 46 of the frame 12 in a region of the throat wall portion 22, the front wall together with the throat wall portion and the webbing further defining the pocket 48.

The webbing 16, an integral unit of molded plastic, defines a ball-receiving surface 52 extending at least between the throat wall portion 22 and the end wall portion 28. The ball-receiving surface 52 is relatively more spaced from the front edge 46 of the frame in a region of the pocket 48 adjacent the throat wall portion 22 than in a region of the end wall portion 28, and the surface 52, in the region of the end wall portion, lies generally tangent with an adjacent portion of the front surface 44. A segment 49 of the webbing 16 in a region of the pocket 48 extends generally perpendicular to a plane, E, of the front edge 46, for further defining the pocket.

The mechanical characteristics of the material of the webbing 16 are selected so that the open grid region 40 deflects resiliently with contact of a ball 50 upon the ball-receiving surface 52 to facilitate catching of the ball, and so that the open grid region 40 resists deflection as the ball 50 passes along the ball-receiving surface 52 during throwing.

As a result of this arrangement of elements, a ball 50 entering the ball-receiving region 14 during catching (arrows C, FIG. 5) is deflected by the ball-receiving surface 52 of the webbing 16 toward the pocket 48 to facilitate catching. A ball 50 leaving the ball-receiving region 14 during throwing (arrows T, FIG. 6) passes smoothly from the ball-receiving surface 52 to the front surface 44 of the end wall in a manner to permit accurate throwing.

The front frame member 20 further includes a frame sleeve 56 on an outer surface 58 of the front frame member in a region of the throat wall portion 22, the frame sleeve being sized for receiving an end 60 of the handle 18 for fixed connection of the frame and the handle.

The handle 18 is covered by a handle sleeve 19 of cushioning material. In the embodiment described, the handle is of a length, L, suitable for use of the toy with one hand, e.g., the handle is about seven inches long.

In commercial embodiments of the sports toy of the invention, the color of each frame member 20, 30 may be the same or different, and the color of the webbing 16 may be the same as or different from one or both of the frame members. Bright, eye-catching colors may typically be selected.

For securement of the front frame member 20 to the rear frame member 30, with the peripheral rim 42 of the webbing 16 disposed therebetween, there is provided an elongated tab 62 defined by the rear frame member, the elongated tab being sized and constructed for engagement within the frame sleeve 56. Screws 90 engaged through the sleeve 56 and the elongated tab 62, into the end 60 of the handle 18, secure together the front and rear frame members and the handle, in the region of the pocket 48.

Also, the front frame member 20 and the rear frame member 30 define a plurality of pairs of corresponding, overlying tabs 64, 65 and fasteners (such as rivets 66) are employed for fixed joining together of the pairs of corresponding, overlying tabs.

Figure 7:
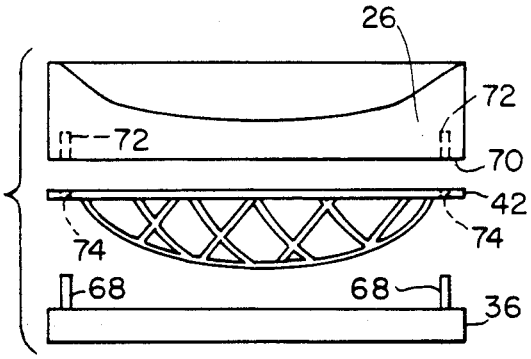
FIG. 7 is a somewhat diagrammatic exploded side view of a segment of the side walls of the front and rear frame elements and the rim of the webbing.
Figure 8:
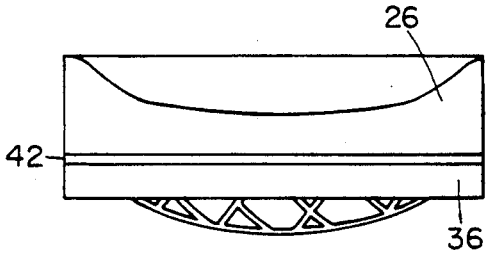
FIG. 8 is a somewhat diagrammatic side view of the segment of the side walls and rim of FIG. 7, as assembled.

Referring to FIGS. 7 and 8, the rear frame member 30 also defines a plurality (e.g., three along each side wall 34, 36) of pin elements 68 formed integrally therewith, and an opposed surface 70 of the front frame member 20 defines a plurality of orifices 72, the orifices 72 being aligned with and corresponding to the pin elements 68. The peripheral rim 42 of the webbing 16 defines a plurality of apertures 74 which are similarly aligned with and correspond to the plurality of pin elements 68 and the plurality of orifices 72. For securement together of the front frame member 20 and the rear frame member 30, with the peripheral rim 42 of the webbing 16 secured therebetween, the pin elements 68 are positioned to extend through the apertures 74 and into engagement in the orifices 72, and then secured therein, e.g. with adhesive or by ultrasonic welding.

Figure 9:
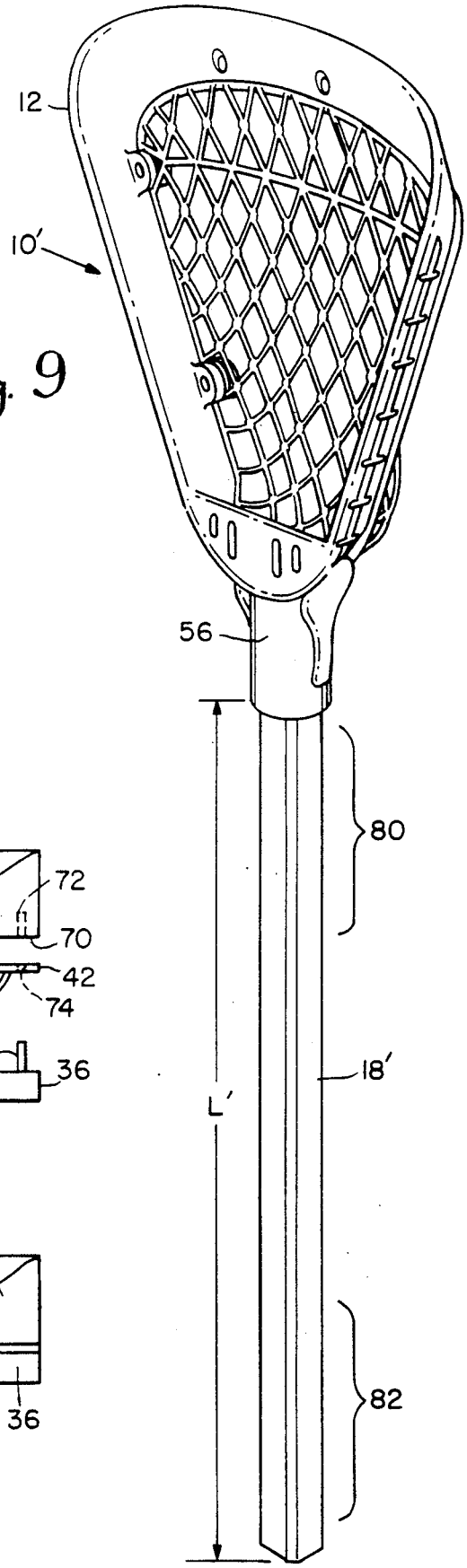
FIG. 9 is a perspective view of another embodiment of a sports toy of the invention.

Other embodiments are within the following claims. For example, referring to FIG. 9, a sport toy 10' has a handle 18' of a length, L', suitable for use of the toy with two hands, a first hand-grasping region 80 being defined by the handle 18' adjacent the frame sleeve 56 and a second hand-grasping region 82 being defined by the handle 18' at a distance spaced from the first hand-grasping region, thereby to permit throwing of a ball with a two-handed motion. In one embodiment, length L' is about 16 inches. The handle 18' may have a handle sleeve of cushioning material, e.g. in the second hand-grasping region only, or there may be no handle sleeve, e.g. as shown in FIG. 9.

What is claimed is:

1. A sport toy for tossing and catching a ball, comprising a frame defining an open, ball-receiving region, a webbing attached to said frame and spanning said ball-receiving region, and a handle connected to said frame, said frame comprising a front frame member having a throat wall portion, a pair of opposed side wall portions diverging from said throat wall portion and an end wall portion spaced from said throat wall portion and extending between said pair of opposed side wall portions, and a rear frame member, and said webbing being formed of a resiliently deformable material and having a peripheral rim sized and adapted to be secured between said front frame member and said rear frame member.

2. The sport toy of claim 1 wherein said end wall of said front frame member has a front surface that slopes from a front edge of said front frame member toward said throat wall portion, and said webbing defines a pocket in a region of said throat wall portion for receiving and retaining a ball.

3. The sport toy of claim 2 wherein said webbing comprises an integral unit of molded plastic, said webbing defining a ball-receiving surface extending at least between said throat wall portion and said end wall portion, said ball-receiving surface being relatively more spaced from a front edge of said frame in a region of said throat wall portion than in a region of said end wall portion, said ball-receiving surface in the region of said end wall portion lying generally tangent with an adjacent portion of said front surface, whereby a ball entering said ball-receiving region during catching is deflected by said ball-receiving surface of said webbing toward said pocket, and a ball leaving said ball-receiving region during throwing passes smoothly from said ball-receiving surface to said front surface.

4. The sport toy of claim 3 wherein a segment of said webbing in a region of said pocket extends generally perpendicular to a plane of said front edge for further defining said pocket.

5. The sport toy of claim 3 or 4 wherein said webbing is adapted to deflect resiliently with contact of a ball upon said ball-receiving surface to facilitate catching of a ball, and said webbing is adapted to resist deflection as a ball passes along said ball-receiving surface during throwing.

6. The sport toy of claim 1 wherein said front frame member further comprises a front wall extending generally along a front edge of said front frame member in a region of said throat wall portion, said front wall together with said throat wall portion and said webbing defining a pocket sized for receiving and retaining a ball.

7. The sport toy of claim 1 wherein said webbing comprises an integral unit of molded plastic, said webbing defining a ball-receiving surface extending at least between said throat wall portion and said end wall portion.

8. The sport toy of claim 1 wherein said front frame member further comprises a frame sleeve disposed upon an outer surface of said front frame member in a region of said throat wall portion, said frame sleeve sized for receiving an end of said handle for fixed connection of said frame and said handle.

9. The sport toy of claim 8 wherein said sports toy further comprises means for securing said front frame member to said rear frame member, with said peripheral rim of said webbing disposed therebetween.

10. The sport toy of claim 9 wherein said means for securing said front frame member to said rear frame member comprises an elongated tab defined by said rear frame member, said elongated tab being sized and constructed for engagement within said frame sleeve.

11. The sport toy of claim 1 wherein said sports toy further comprises means for securing said front frame member to said rear frame member, with said peripheral rim of said webbing disposed therebetween.

12. The sport toy of claim 10 or 11 wherein said means for securing said front frame member to said rear frame member comprises a plurality of pairs of corresponding, overlying tabs defined by said front frame member and said rear frame member, and fasteners sized and adapted for fixed joining together of said pairs of corresponding, overlying tabs.

13. The sport toy of claim 12 wherein said fasteners comprises rivets.

14. The sport toy of claim 10 or 11 wherein said means for securing said front frame member to said rear frame member, with the peripheral rim of said webbing disposed therebetween, comprises a plurality of pin elements formed integrally with one said frame member, a plurality of orifices defined by an opposed surface of the other said frame member and aligned with and corresponding to said plurality of pin elements, and a plurality of apertures defined by said peripheral rim of said webbing and similarly aligned with and corresponding to said plurality of pin elements and said plurality of orifices, said pin elements extending through said apertures and into engagement in said orifices for securement together of said front frame member and said rear frame member, with said peripheral rim of said webbing therebetween.

15. The sport toy of claim 14 wherein said plurality of orifice are defined by said front frame member and said plurality of pin elements are defined by said rear frame member.

16. The sport toy of claim 1 wherein said handle is of a length suitable for use of the toy with one hand.

17. The sport toy of claim 16 wherein said length is of the order of about seven inches.

18. The sport toy of claim 1 or 16 wherein said handle comprises a handle sleeve of cushioning material.

19. The sport toy of claim 1 wherein said handle is of a length suitable for use of the toy with two hands, a first hand-grasping region being defined by said handle adjacent said frame sleeve and a second hand-grasping region being defined by said handle at a distance spaced from said first hand-grasping region, thereby to permit throwing of a ball with a two-handed motion.

20. The sport toy of claim 19 wherein said length is of the order of about sixteen inches.

21. A sport toy for tossing and catching a ball, comprising a frame defining an open, ball-receiving region, a webbing attached to said frame and spanning said ball-receiving region, a handle connected to said frame, said frame comprising a front frame member having a throat wall portion, a pair of opposed side wall portions diverging from said throat wall portion and an end wall portion spaced from said throat wall portion and extending between said pair of opposed side wall portions, said end wall portion having a front surface that slopes from a front edge of said front frame member toward said throat wall portion, and a rear frame member, and said webbing comprising an integral unit of molded, resiliently deformable plastic, said webbing having a peripheral rim sized and adapted to be secured between said front frame member and said rear frame member, said webbing defining a pocket in a region of said throat wall portion for receiving and retaining a ball, and said webbing further defining a ball-receiving surface extending at least between said throat wall portion and said end wall portion, said ball-receiving surface being relatively more spaced from a front edge of said frame in a region of said throat wall portion than in a region of said end wall portion, said ball-receiving surface in the region of said end wall portion lying generally tangent with an adjacent portion of said front surface, a segment of said webbing in a region of said pocket extending generally perpendicular to a plane of said front edge for defining said pocket, and said webbing being adapted to deflect resiliently with contact of a ball upon said ball-receiving surface to facilitate catching of a ball, and said webbing being adapted to resist deflection as a ball passes along said ball-receiving surface during throwing, whereby a ball entering said ball-receiving region during catching is deflected by said ball-receiving surface of said webbing toward said pocket, and a ball leaving said ball-receiving region during throwing passes smoothly from said ball-receiving surface to said front surface.

22. The sport toy of claim 21 wherein said front frame member further comprises a frame sleeve disposed upon an outer surface of said front frame member in a region of said throat wall portion, said frame sleeve sized for receiving an end of said handle for fixed connection of said frame and said handle, and said sports toy further comprises means for securing said front frame member to said rear frame member, said means for securing comprising:

an elongated tab defined by said rear frame member, said elongated tab being sized and constructed for engagement within said frame sleeve, a plurality of pairs of corresponding, overlying tabs defined by said front frame member and said rear frame member with fasteners sized and adapted for fixed joining together of said pairs of corresponding, overlying tabs, and a plurality of pin elements formed integrally with said rear frame member, a plurality of orifices defined by an opposed surface of said front frame member and aligned with and corresponding to said plurality of pin elements, and a plurality of apertures defined by said peripheral rim of said webbing and similarly aligned with and corresponding to said plurality of pin elements and said plurality of orifices, said pin elements extending through said apertures and into engagement in said orifices for securement together of said front frame member and said rear frame member, with said peripheral rim of said webbing therebetween.

23. The sport toy of claim 21 wherein said handle is of a length suitable for use of the toy with one hand.

24. The sport toy of claim 21 or 23 wherein said handle comprises a handle sleeve of cushioning material.

25. The sport toy of claim 21 wherein said handle is of a length suitable for use of the toy with two hands, a first hand-grasping region being defined by said handle adjacent said frame sleeve and a second hand-grasping region being defined by said handle at a distance spaced from said first hand-grasping region, thereby to permit throwing of a ball with a two-handed motion.

26. A sport toy for tossing and catching a ball, comprising a frame defining an open, ball-receiving region, a webbing attached to said frame and spanning said ball-receiving region, a handle connected to said frame, said frame comprising a front frame member having a throat wall portion, a pair of opposed side wall portions diverging from said throat wall portion and an end wall portion spaced from said throat wall portion and extending between said pair of opposed side wall portions, and a frame sleeve disposed upon an outer surface of said front frame member in a region of said throat wall portion, said frame sleeve sized for receiving an end of said handle for fixed connection of said frame and said handle, and a rear frame member, and said webbing being formed of a resiliently deformable material and having a peripheral rim sized and adapted to be secured between said front frame member and said rear frame member, and means for securing said front frame member to said rear frame member, with the peripheral rim of said webbing disposed therebetween, said means for securing comprising:

an elongated tab defined by said rear frame member, said elongated tab being sized and constructed for engagement within said frame sleeve, a plurality of pairs of corresponding, overlying tabs defined by said front frame member and said rear frame member with fasteners sized and adapted for fixed joining together of said pairs of corresponding, overlying tabs, and a plurality of pin elements formed integrally with said rear frame member, a plurality of orifices defined by an opposed surface of said front frame member and aligned with and corresponding to said plurality of pin elements, and a plurality of apertures defined by said peripheral rim of said webbing and similarly aligned with and corresponding to said plurality of pin elements and said plurality of orifices, said pin elements extending through said apertures and into engagement in said orifices for securement together of said front frame member and said rear frame member, with said peripheral rim of said webbing therebetween.

* * * * *